United States Patent [19]

Poppendiek

[11] Patent Number: 4,751,040

[45] Date of Patent: Jun. 14, 1988

[54] MEANS AND TECHNIQUES USEFUL IN THE MONITORING AND ACCOUNTABILITY OF RADIOACTIVE MATERIALS

[75] Inventor: Heinz F. Poppendiek, La Jolla, Calif.

[73] Assignee: Geoscience Ltd., Solana Beach, Calif.

[21] Appl. No.: 350,304

[22] Filed: Feb. 19, 1982

[51] Int. Cl.[4] ..... G21C 19/00

[52] U.S. Cl. ..... 376/272; 376/247

[58] Field of Search ..... 376/272, 247, 250, 254, 376/298, 299

[56] References Cited

U.S. PATENT DOCUMENTS 3,073,961 1/1963 Nachbar ..... 376/272

*Primary Examiner*—Donald P. Walsh

*Attorney, Agent, or Firm*—Frank E. Mauritz

[57] ABSTRACT

Afterheat being released from a radioactive storage system is measured and monitored. Changes in heat release with respect to time is related to expected radioactive decay processes of the confined radioactive materials. Material leakage from storage is detected and defined by deviations from the normal expected heat release-time function being monitored. Such deviations or lack of deviations, as the case may be, provide the desired accountability of the radioactive materials.

9 Claims, 1 Drawing Sheet

MEANS AND TECHNIQUES USEFUL IN THE MONITORING AND ACCOUNTABILITY OF RADIOACTIVE MATERIALS

The present invention relates to the disposal and storage of nuclear waste and in particular to means and techniques for monitoring and for administrative control of sealed radioactive storage sites and in general to a radioactive waste accountability system based on heat flux monitoring.

Concern about the integrity of long-term radioactive waste storage systems has delayed not only the implementation of such storage but has disrupted the nuclear fuel cycle program. There is a need for reliable accountability and verification of the soundness of radioactive waste storage systems. Storage plans previously suggested involve routine radiological monitoring, but past experience with radiation monitoring systems has shown that such equipment is subject to breakdowns and an accuracy degradation as time goes on.

An object of the present invention is to provide an improved radioactive material monitoring and accounting system that operates independently of existing systems and may be used as a backup system to existing systems which depend on their operation for the monitoring or detection of radiation.

A specific object of the present invention is to provide an improved system of this character which operates on the principle of monitoring the heat flow from confined radioactive materials.

Another specific object of the present invention is to provide a system as set forth in the preceding paragraph featured by the fact that it incorporates means whereby the heat flow monitoring means may be readily calibrated and recalibrated as desired.

A further object of the present invention is to provide a monitoring system of this character which requires no power supply except a power source for its calibration.

Figure 1:
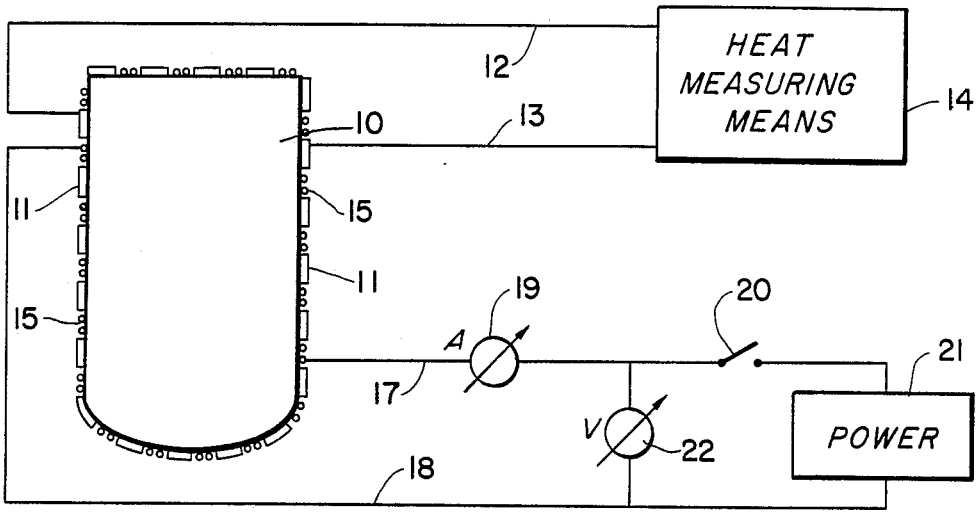
FIG. 1 illustrates a system embodying features of the present invention.

The radioactive materials in the form of isotopes are confined in a generally cylindrical container 10 which has its ends closed.

A unique heat flux sensor system is illustrated as being mounted on the outer surface of the storage container 10 although it and its associated calibration system involving heater wires may be mounted within the wall or walls of container 10. The system monitors or measures the sum total or integrated waste heat release leaving the container 10.

The heat flux sensor system includes heat flux sensors illustrated at 11 of the type involving thermocouples or thermopiles that are spirally disposed around the generally cylindrical container 10. These are connected in electrical series relationship to produce an electrical output in response to heat on the output leads to which a suitable electrical meter, i.e., a heat measuring means is connected.

The heat flux sensors 11 are strategically located with respect to anticipated heat flow and may cover only 10 percent of the container outer surface and are preferably thin so as to offer minimum resistance to heat flow.

To calibrate the heat flow measuring system resistance wire 15 is spirally wound around the container 10, but in spaced relationship to the spirally wound heat sensors 11. The leads 17,18 of wire 15 is connectable to an electrical power source 21 via ammeter 19 and on-off switch 20. A voltmeter 22 is connectable across the power source 21 by the switch 20 and the power consumption in resistance wire 15 is established by multiplying the readings of ammeter 19 and voltmeter 21.

Figure 2:
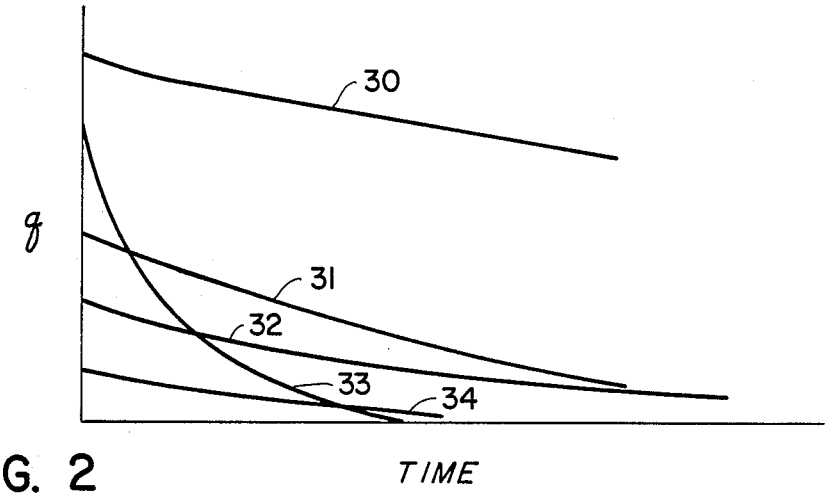
FIG. 2 is a intended to represent the decay times of heat of various radioactive materials in the container in FIG. 1.
Figure 3:
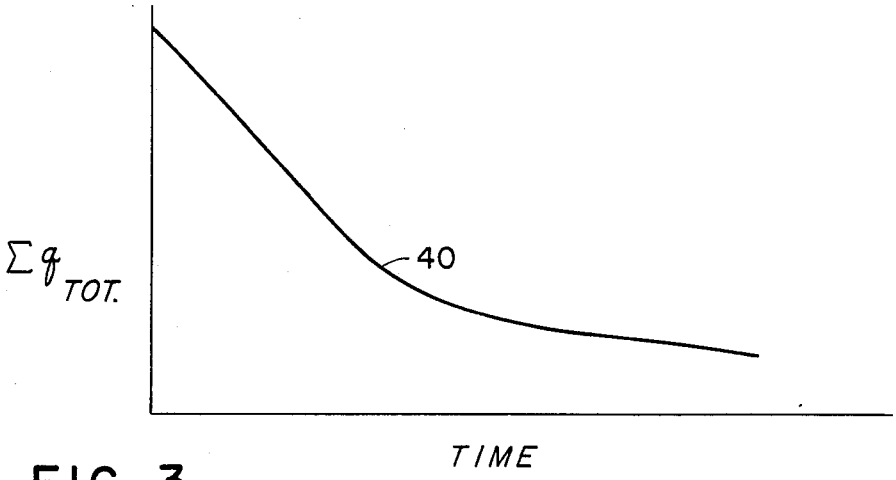
FIG. 3 is intended to illustrate the sum total of the heat produced by all of the radioactive materials represented in FIG. 2.

FIG. 2 illustrates graphically the manner in which the heat produced by radioactive materials 30, 31, 32, 33, and 34 in container diminishes as time elapses. The ordinates in the curve are q, heat flow and the abscissae are time. It is noted as the materials lose their radioactivity the heat produced likewise lessens as indicated in FIG. 2. The sum total of the heat produced by materials 30–34 is illustrated as the ordinates in FIG. 3 and as indicated as $q_{tot}$. It is noted that the graph 40 has a shape depending upon the different decay rates of the materials 30–34 as well as the particular time in which the heat flow therefrom becomes substantially equal to zero. It is thus expected that the shape of the graph 40 as to slope, duration, flex points and other characteristics may be anticipated beforehand with knowledge of the contents of container 10 and that any deviation from that which can be anticipated with any degree of accuracy may serve useful purposes in accounting for the effectiveness of the container serving as such.

The initial evaluation of the decay graph 40 is defined by the assay provided for the material in container 10. As measurements are being made, some minor deviations may be noted between the measured and the predicted decay of the heat release rates because of uncertainties in the material content. Nevertheless the heat release curve 40 would be a well-defined time-decay function; any marked deviation from its, or discontinuity in it, indicates material loss from container 10.

The heat flow measuring or monitoring means may be periodically calibrated by closing switch 20, noting the readings of the ammeter 19 and voltmeter 22 after waiting for thermal equalibrium to be established to ascertain power or heat input from the calibration system and correlating that heat input with the reading resulting therefrom on the heat measuring means 14. The heat flux sensor system is table so that calibration may be readily effected with an accuracy determined by the accuracies of electrical laboratory ammeters and voltmeters used in its calibration.

The sensor and calibration system is preferably made of materials that are relatively unaffected by modest nuclear radiation fields.

It will be appreciated that during the calibration process the heat sensing means senses the heat produced by the radioactive materials as well as the heat produced by the calibration means. There is an initial reading indicative of the heat produced by the radioactive materials alone and then a later reading indicative of the heat produced by both the radioactive materials and the calibration means. The effect of each may be established by subtracting the initial reading from the later reading.

I claim:

1. A radioactive material storage system, and a heat flux sensor system positioned on said storage system to surround the same in (a) the path of all anticipated heat flow being developed by radioactive materials while still in said storage system, said heat flow path being in a direction outwardly of said storage system and through said sensor system, said sensor system producing an output representative of the quantity of said heat flow.

2. In a system for determining information related to the presence of radioactive materials in a radioactive storage system, the step of measuring (the) a quantity representative of the flow of all heat being produced in (a direction0 all directions out of said storage system by said materials in said storage system.

3. In an arrangement as set forth in claim 1 including a system for calibrating said sensor system, said calibrating system including means for producing additional heat sensed by said sensor system.

4. A system as set forth in claim 2 including the step of producing heat for calibration purposes such that measuring of both the heat flow from the radioactive materials and the produced heat results.

5. A radioactive storage system as set forth in claim 1 on which a series of heat flux sensing means is circumferentially disposed, and heat producing means is circumferentially disposed about said system for producing a source of calibration heat sensed by said flux sensing means.

6. An arrangement as set forth in claim 5 in which said heat producing means is spaced from said heat flux sensing means.

7. A system as set forth in claim 4 including measuring a characteristic of the produced heat.

8. a system as set forth in claim 3 in which said heat producing means includes electrical heating means, and means for measuring the amount of power being supplied to said electrical heating means.

9. A system as set forth in claim 4 in which the heat produced by said radioactive materials alone is measured to achieve a first measurement, then the heat produced by said radioactive materials together with the heat produced by said calibrating system is measured to achieve a second measurement, and subtracting said first measurement from said second measurement.

* * * * *